US007086104B1

(12) United States Patent
Tsay

(10) Patent No.: US 7,086,104 B1
(45) Date of Patent: Aug. 8, 2006

(54) AIR CUSHION WITH SELECTIVELY DEFLATED CHAMBERS

(76) Inventor: Ren-Ji Tsay, 2F-3, No. 11, Lane 250, Sec. 5, Nanjing E. Rd., Taipei (TW)

( * ) Notice: Subject to any disclaimer, the term of this patent is extended or adjusted under 35 U.S.C. 154(b) by 0 days.

(21) Appl. No.: 11/047,636

(22) Filed: Feb. 2, 2005

(51) Int. Cl.
*A47C 27/10* (2006.01)

(52) U.S. Cl. ..... 5/655.3; 5/713; 5/710; 5/711; 5/712

(58) Field of Classification Search ..... 5/655.3, 5/654, 644, 706, 710, 713, 711, 712
See application file for complete search history.

(56) References Cited

U.S. PATENT DOCUMENTS

| | | | | | |
|---|---|---|---|---|---|
| 2,998,817 | A | | 9/1961 | Armstrong | |
| 4,042,988 | A | * | 8/1977 | Holliday | 5/710 |
| 4,679,264 | A | * | 7/1987 | Mollura | 5/710 |
| 5,070,560 | A | * | 12/1991 | Wilkinson | 5/710 |
| 5,267,364 | A | * | 12/1993 | Volk | 5/713 |
| 5,421,044 | A | * | 6/1995 | Steensen | 5/710 |
| 5,584,085 | A | * | 12/1996 | Banko | 5/710 |
| 5,634,224 | A | * | 6/1997 | Gates | 5/709 |
| 5,634,225 | A | | 6/1997 | Miller, Sr. et al. | |
| 5,647,078 | A | | 7/1997 | Pekar | |
| 5,745,941 | A | * | 5/1998 | Miller, Sr. | 5/710 |
| 5,966,762 | A | * | 10/1999 | Wu | 5/710 |
| 5,991,949 | A | * | 11/1999 | Miller et al. | 5/710 |
| 6,006,383 | A | * | 12/1999 | Pile et al. | 5/706 |
| 6,065,166 | A | * | 5/2000 | Sharrock et al. | 5/630 |
| 6,148,461 | A | * | 11/2000 | Cook et al. | 5/713 |
| 6,163,909 | A | * | 12/2000 | Lin | 5/713 |
| 6,321,404 | B1 | | 11/2001 | Tsai | |
| 6,349,439 | B1 | * | 2/2002 | Cook et al. | 5/713 |
| 6,671,912 | B1 | | 1/2004 | Tsai et al. | |
| 6,691,355 | B1 | * | 2/2004 | Liu | 5/714 |
| 6,711,771 | B1 | * | 3/2004 | Cook et al. | 5/713 |
| 2002/0016995 | A1 | * | 2/2002 | Cook et al. | 5/713 |

* cited by examiner

*Primary Examiner*—Robert G. Santos
(74) *Attorney, Agent, or Firm*—Rosenberg, Klein & Lee

(57) ABSTRACT

An air cushion with selectively deflated chambers has a base, multiple air pouches, multiple attachment devices, at least two air tubes, an air pump and a cover sheet. The air pouches are mounted on the base, and each air pouch has an inner space and multiple compression straps. The inner space is divided into multiple chambers that communicate with each other. Each compression strap keeps a selected chamber of the air pouches from inflating. The attachment devices are mounted on the base to attach the air pouches to the base. The at least two air tubes connect to the air pouches and communicates with the inner spaces of the air pouches. The air pump connects to and pumps air through the air tubes into the air pouches. Any one of the chambers can be kept from inflating if the chamber contacts injured skin of a patient.

2 Claims, 3 Drawing Sheets

AIR CUSHION WITH SELECTIVELY DEFLATED CHAMBERS

BACKGROUND OF THE INVENTION

1. Field of the Invention

The present invention relates to an air cushion, especially to an air cushion that has selectively deflated chambers.

2. Description of the Prior Arts

Air cushions can be mattresses for patients who have injuries to the skin or have bedsore. With reference to the U.S. Pat. No. 6,671,912 entitled "Modulated air cushion," a conventional air cushion comprises a base, multiple air pouches, multiple tubes, an air pump and a cover sheet. The base has bonding elements. The air pouches are attached on the bonding elements and have corresponding bonding elements by which the air pouches are attached to the base. The tubes connect to and communicate with the air pouches. The air pump pumps air through the tubes into the air pouches. Any one of the air pouches can be removed depending on the need to relieve pressure on a specific area that cannot have any air pouches, such as injured skin of a patient. However, the user has to find other spaces to stow the removed air pouches and making multiple small air pouches is expensive.

To overcome the shortcomings, the present invention provides an air cushion with selectively deflated chambers to mitigate or obviate the aforementioned problems.

SUMMARY OF THE INVENTION

The main objective of the present invention is to provide an air cushion with selectively deflated chambers that has multiple air pouches with multiple chambers. The air cushion with selectively deflated chambers has a base, multiple air pouches, multiple attachment devices, at least two air tubes, an air pump and a cover sheet. The air pouches are mounted on the base, and each air pouch has an inner space and multiple compression straps. The inner space is divided into multiple chambers that communicate with one another. Each compression strap keeps a selected chamber of the air pouches from inflating. The attachment devices are mounted on the base to attach the air pouches to the base. The at least two air tubes connect to the air pouches and communicate with the inner spaces of the air pouches. The air pump connects to and pumps air through the air tubes into the air pouches. Any one of the chambers can be kept from inflating if the chamber is going to contact injured skin of a patient.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
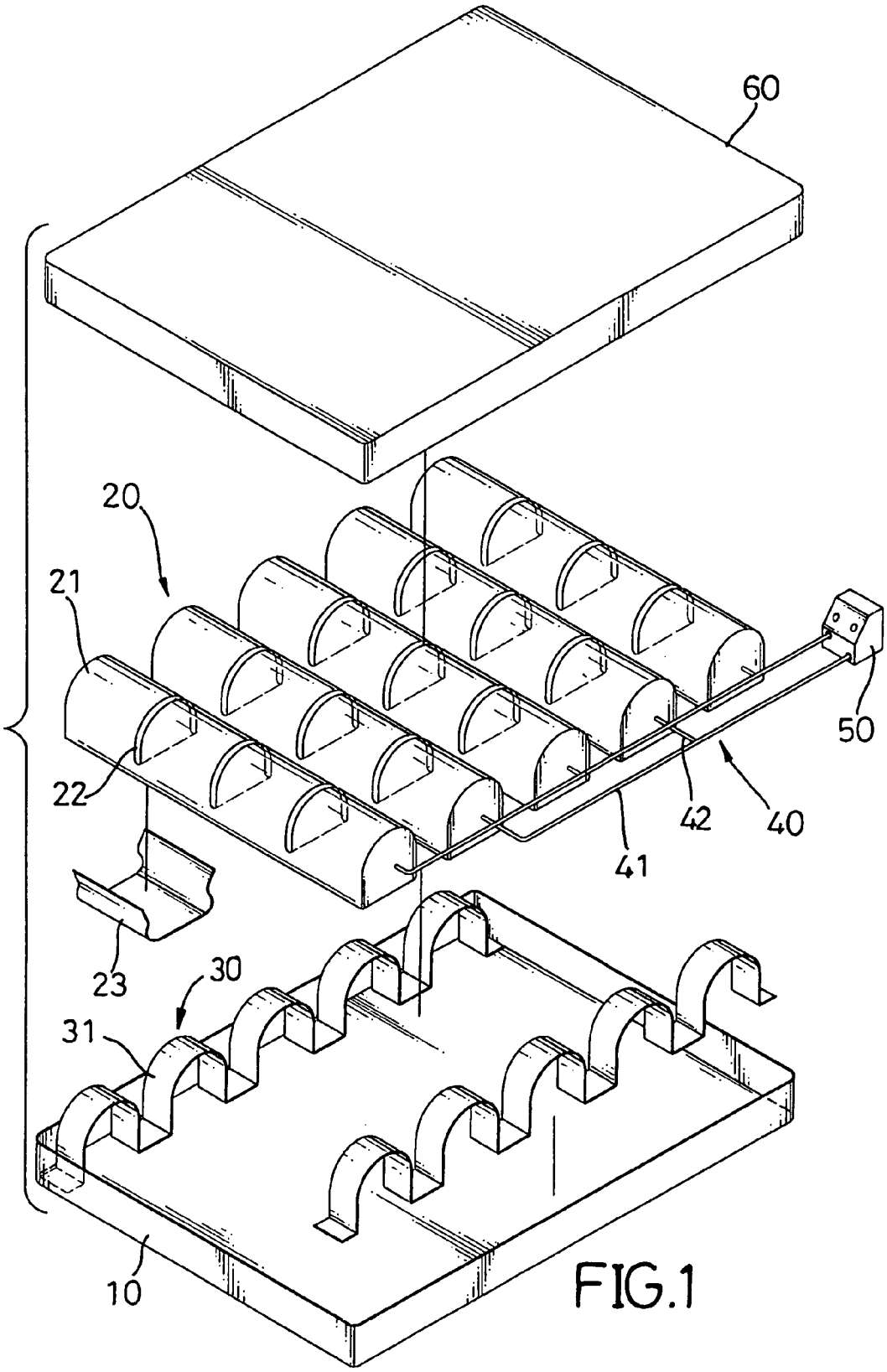
FIG. 1 is an exploded perspective view of an air cushion with selectively deflated chambers in accordance with the present invention.

With reference to FIG. 1, an air cushion with selectively deflated chambers in accordance with the present invention comprises a base (10), multiple air pouches (20), multiple attachment devices (30), at least two air tubes (40), an air pump (50) and a cover pad (60).

The base (10) has a top surface.

Figure 2:
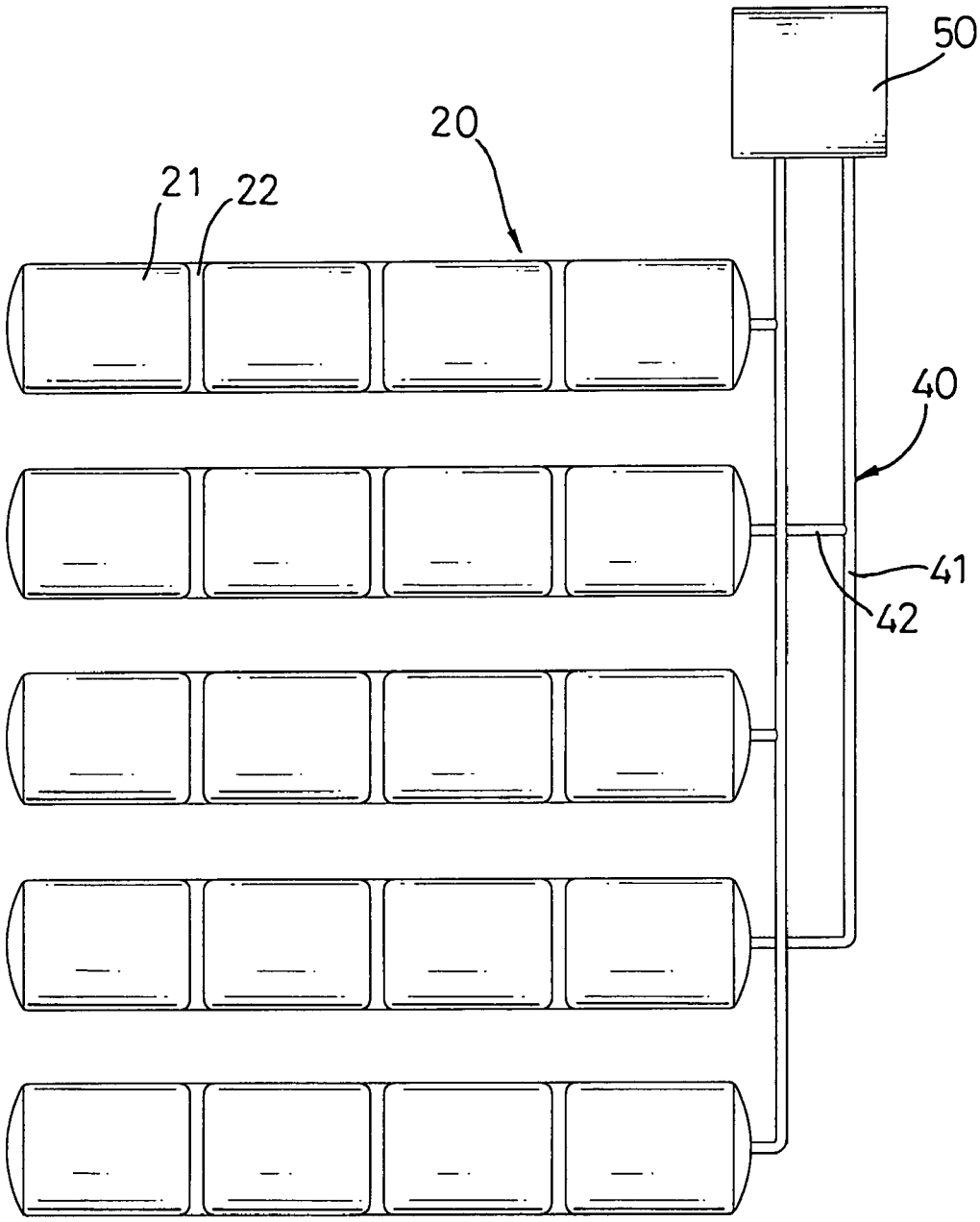
FIG. 2 is a top view of the air pouches connect to the pump in the air cushion in FIG. 1.
Figure 3:
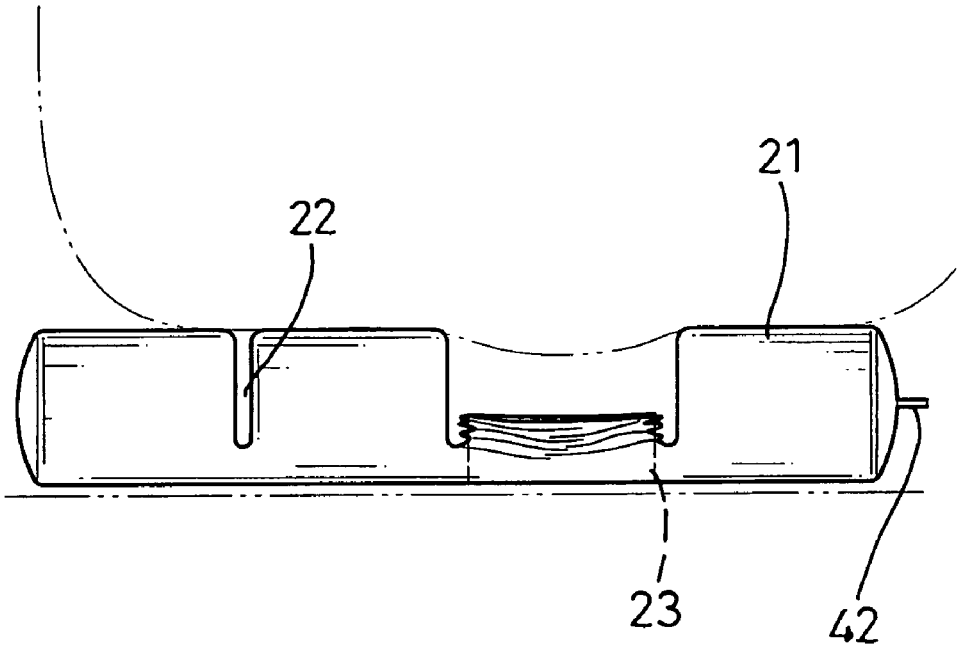
FIG. 3 is an operational front view of an air pouch in the air cushion in FIG. 1.

With further reference to FIGS. 2 and 3, the air pouches (20) are mounted on the top surface of the base (10). Each air pouch (20) has a top, a bottom, an inner space, at least one partitioning gap (22) and multiple compression straps (23). The inner space is divided into multiple chambers (21) that communicate with one another. The at least one partitioning gap (22) is formed in the top, and each partitioning gap (22) separates adjacent chambers (21). The compression straps (23) are selectively mounted respectively over the chambers (21) to keep selected chambers (21) from inflating. After the compression straps (23) are mounted over the selected chamber (21), the chambers (21) that are not compressed still communicate to one another.

The attachment devices (30) are mounted on the top surface of the base (10) to attach the air pouches (20) to the base (10). Each attachment device (30) may have multiple arches (31) arranged separately in a row. The arches (31) respectively clamp the air pouches (20) to attach to the base (10).

The at least two tubes (40) connect to the air pouches (20), and each tube (40) has a main tube (41) and multiple feeder tubes (42). The feeder tubes (42) connect the main tube (41) to the air pouches (20) and communicate with the inner space of the air pouches (20).

The air pump (50) connects to and pumps air alternatively through the at least two tubes (40) into the air pouches (20).

The cover pad (60) covers the base (10) and the air pouches (20).

Since the air cushion has multiple air pouches (20) with multiple chambers (21) instead of having many air pouches with a single air chamber, the selected chamber (21) can be mounted over by the compression strap (23) and the cost of the air pouches is reduced.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An air cushion with selectively deflated chambers comprising a base having a top surface;

multiple air pouches mounted on the top surface of the base, and each air pouch having a top;

a bottom;

an inner space divided into multiple chambers that communicate with one another;

at least one partitioning gap formed in the top wherein each partitioning gap separates adjacent chambers; and multiple compression straps selectively mounted respectively over the chambers;

multiple attachment devices mounted on the base to attach the air pouches to the base;

at least two air tubes connecting to the air pouches, and each one of the at least two tubes having a main tube; and multiple feeder tubes connecting the main tube to the air pouches and communicating with the inner space of the air pouches;

an air pump connecting to and pumping air alternatively through the at least two tubes into the air pouches; and a cover pad covering the base and the air pouches.

2. The air cushion as claimed in claim 1, wherein each attachment device comprises multiple arches arranged separately in a row and respectively clamping the air pouches.

* * * * *